US006775844B1

(12) United States Patent
Castillo

(10) Patent No.: US 6,775,844 B1
(45) Date of Patent: Aug. 17, 2004

(54) ARM SHADES

(76) Inventor: Patrick Castillo, 8350 Santa Monica Blvd. #100, West Hollywood, CA (US) 90069

( * ) Notice: Subject to any disclaimer, the term of this patent is extended or adjusted under 35 U.S.C. 154(b) by 0 days.

(21) Appl. No.: 10/748,077

(22) Filed: Dec. 31, 2003

(51) Int. Cl.[7] ..... A61F 9/00
(52) U.S. Cl. ..... 2/16
(58) Field of Search ..... 2/16, 59, 60, 158, 2/159, 20, 97, 161.1, 161.4, 161.5, 161.6, 162, 167, 125, 126, 458, 910

(56) References Cited

U.S. PATENT DOCUMENTS 1,117,077 A * 11/1914 Mooney ..... 2/16
5,056,157 A 10/1991 Pryor
5,092,235 A * 3/1992 Rise ..... 100/168
5,357,633 A * 10/1994 Rael ..... 2/16
5,628,062 A 5/1997 Tseng
5,638,546 A * 6/1997 Vita ..... 2/16
5,974,586 A 11/1999 Reinoso
5,983,391 A * 11/1999 Palmer et al. ..... 2/16
6,076,189 A * 6/2000 Christman et al. ..... 2/158
6,240,565 B1 * 6/2001 Spear ..... 2/158

* cited by examiner

*Primary Examiner*—Tejash Patel
(74) *Attorney, Agent, or Firm*—Matthew J. Peirce

(57) ABSTRACT

A health apparatus for use by individuals while driving is disclosed. The health apparatus would be an arm shield which would be worn over an individual's "outside arm" while driving. The arm shield would reduce sun exposure on the arm and would be attached via two end-mounted elastic bands. An extra hood could be wrapped around the individual's hand on the outside arm for added protection.

5 Claims, 2 Drawing Sheets

ARM SHADES

BACKGROUND OF THE INVENTION

The present invention concerns that of a new and improved health apparatus for use by individuals while driving.

DESCRIPTION OF THE PRIOR ART

U.S. Pat. No. 5,974,586, issued to Reinoso, discloses a pair of sleeves to be worn by a user to provide sun protection for the skin on the arms and shoulders.

U.S. Pat. No. 5,628,062, issued to Tseng, discloses an arm protection UV-proof sleeve secured with an elastic closure for use by a driver to prevent skin damage from the sun.

U.S. Pat. No. 5,056,157, issued to Pryor, discloses a fabric covering for protecting the upper arm of an individual from excess solar radiation while projecting an arm out of the window of a vehicle.

SUMMARY OF THE INVENTION

The present invention concerns that of a new and improved health apparatus for use by individuals while driving. The health apparatus would be an arm shield which would be worn over an individual's "outside arm" while driving. The arm shield would reduce sun exposure on the arm and would be attached via two end-mounted elastic bands. An extra hood could be wrapped around the individual's hand on the outside arm for added protection.

There has thus been outlined, rather broadly, the more important features of a health apparatus for use by individuals while driving that the detailed description thereof that follows may be better understood and in order that the present contribution to the art may be better appreciated. There are, of course, additional features of the health apparatus for use by individuals while driving that will be described hereinafter and which will form the subject matter of the claims appended hereto.

In this respect, before explaining at least one embodiment of the health apparatus for use by individuals while driving in detail, it is to be understood that the health apparatus for use by individuals while driving is not limited in its application to the details of construction and to the arrangements of the components set forth in the following description or illustrated in the drawings. The health apparatus for use by individuals while driving is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present health apparatus for use by individuals while driving. It is important, therefore, that the claims be regarded as including such equivalent constructions insofar as they do not depart from the spirit and scope of the present invention.

It is therefore an object of the present invention to provide a health apparatus for use by individuals while driving which has all of the advantages of the prior art and none of the disadvantages.

It is another object of the present invention to provide a health apparatus for use by individuals while driving which may be easily and efficiently manufactured and marketed.

It is another object of the present invention to provide a health apparatus for use by individuals while driving which is of durable and reliable construction.

It is yet another object of the present invention to provide a health apparatus for use by individuals while driving which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Priority is hereby claimed to application 60/437,087, filed on Dec. 31, 2002.

Figure 1:
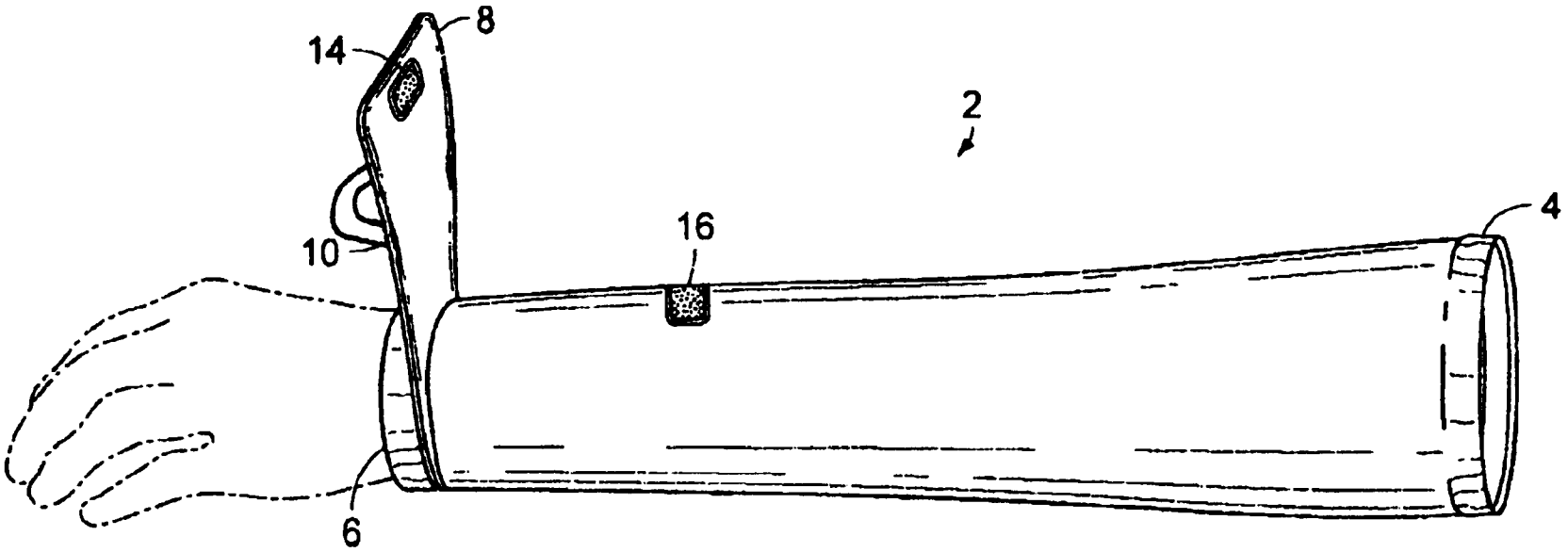
FIG. 1 shows a side view of the present invention.

FIG. 1 shows a side view of the present invention. Arm shield 2 would have two ends, a first end and a second end, with each end being open. Arm shield 2 is tubular and has a varying diameter. The first end of the arm shield 2 would have a diameter of ten inches, while the second end of arm shield 2 would be have a diameter of four inches.

Arm shield 2 itself would preferably be fabricated from a thermo-type cotton fabric or a 80% cotton/20% lycra/spandex weave. To ensure that arm shield 2 would stay attached to an individual's arm, the first end of arm shield 2 would have elastic band 4, while the second end of arm shield 2 would have elastic band 6. Each elastic band would be circumferentially attached to the arm shield 2.

Arm shield 2 would also have a hood 8 which would be attached to the arm shield 2 near the second end of the arm shield 2. Hood 8 has two ends, a first end and a second end, with the first end of the hood 8 being attached to the arm shield 2. Hood 8 also has two sides, a first side and a second side. Hood 8 would merely be an extra piece of fabric that would be wrapped around an individual's hand after the arm shield 2 had been placed over an individual's arm.

Attached to hood 8 is elastic strap 10. Strap 10 has two ends, a first end and a second end, with the first end attached to the first side of the hood 8 and the second end of the strap 10 attached to the second end of the hood 8.

In order to secure hood 8 around a person's hand, the hood would be folded over to cover the sunlight-exposed portion of a user's hand. Then, the individual would insert their hand through strap 10 so that strap 10 would wind around underneath the individual's hand. Strap 10 helps the hood 8 to remain fixed in a position immediately above the person's hand.

Figure 2:
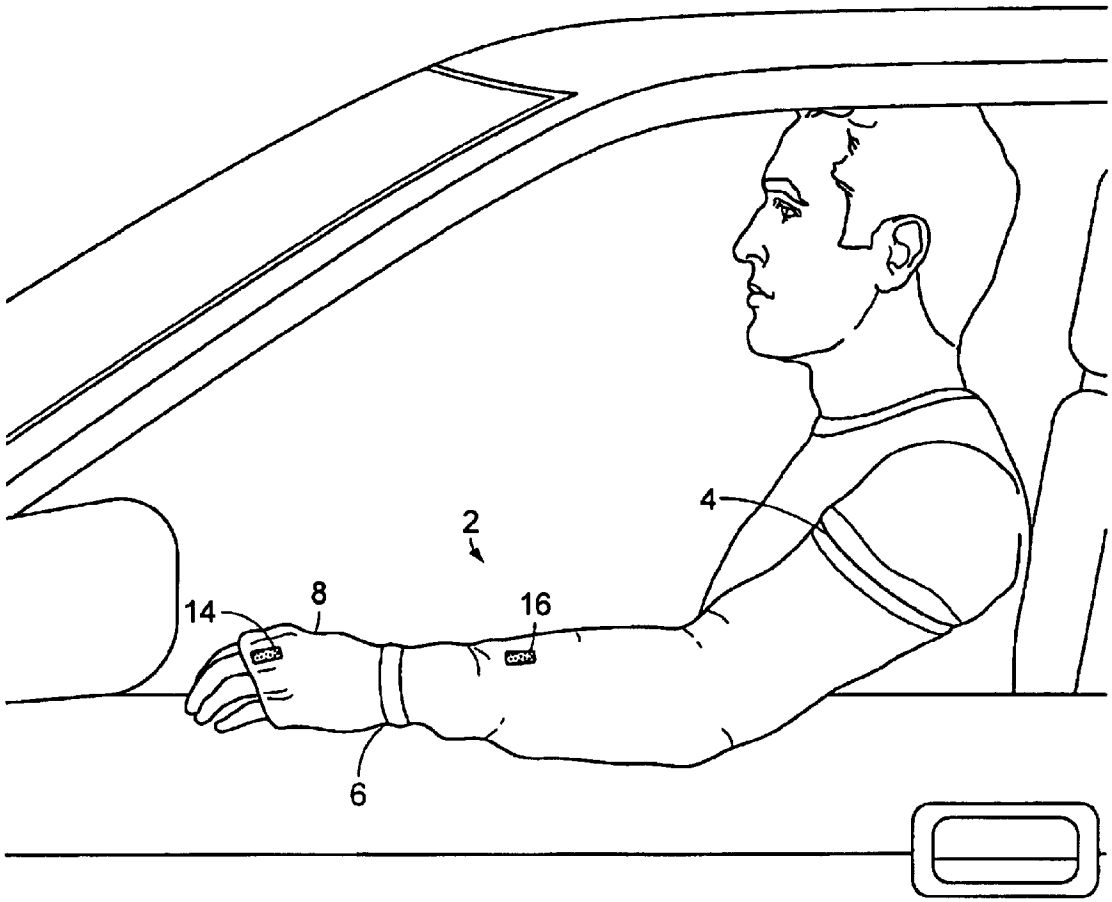
FIG. 2 shows a representative view of the present invention as it would appear in use.

FIG. 2 shows a representative view of the present invention as it would appear in use. Arm shield 2 would be most useful when an individual would be driving with their window down, would be wearing short sleeves, and would have some sun exposure on the "outside arm," or in other words, the arm closest to the outside. Arm shield 2 would allow the individual's outside arm to experience air flow, while at the same time, would virtually eliminate any chance of the individual receiving sun exposure on the outside arm. Arm shield 2 would therefore reduce excessive sun exposure on the covered skin, which is quite important now that the ozone layer is somewhat diminished.

Also, patch 14 on hood 8 is shown, along with patch 16. Patch 14 and 16 are each a patch of a two-part complementary hook and loop attachment system, with each patch having a plurality of connectors 18. One of the plurality of connectors is a plurality of hooks, while the other plurality of connectors is a plurality of loops. When attached to one another, they will be removably connected to one another until pulled apart. A user could removably attach the second end to the arm shield 2 by placing patch 14 against patch 16 on the arm shield 2. When attached to one another, the hood 8 will be removably connected to the arm shield 2 until pulled apart.

What I claim as my invention is:

1. A health apparatus for protecting an arm from sunlight, the health apparatus comprising:

(a) an arm covering having two ends, a first end and a second end, each of the arm covering being open, the arm covering being tubular and having a varying diameter, the first end of the arm covering having a diameter of ten inches, the second end of the arm covering having a diameter of four inches, (b) a pair of elastic bands comprising a first elastic band and a second elastic band, the first elastic band attached to the first end of the arm covering, the second elastic band attached to the second end of the arm covering, (c) a hood having two ends, a first end and a second end, the hood also having two sides, a first side and a second side, the first end being attached to the arm covering near the second end of the arm covering, (d) means for securing the hood over a hand, and (e) means for removably attaching the second end of the hood to the arm covering.

2. A health apparatus for protecting an arm from sunlight according to claim 1 wherein the means for securing the hood over a hand further comprises:

(a) an elastic strap having two ends, a first end and a second end, the first end of the elastic strap attached to the first side of the hood, the second end of the elastic strap attached to the second side of the hood, (b) wherein the hood is wrapped over a person's hand, and further wherein the inserts said hand through the elastic strap.

3. A health apparatus for protecting an arm from sunlight according to claim 2 wherein the means for removably attaching the second end of the hood to the arm covering further comprises:

(a) a first patch of a complementary hook and loop attachment system, the first patch attached to the hood, (b) a second patch of a complementary hook and loop attachment system, the second patch attached to the arm covering, (c) wherein the hood is wrapped over the arm covering in such a manner that the first patch on the first strap and the second patch on the second strap are placed into contact with each other, and further wherein the first patch and the second patch are complementary to one another and are removably attached to one another.

4. A health apparatus for protecting an arm from sunlight according to claim 3 wherein the arm covering is fabricated from cotton.

5. A health apparatus for protecting an arm from sunlight according to claim 3 wherein the arm covering is fabricated from 80% cotton and from a 20% synthetic material.

* * * * *